United States Patent [19]

Braddock et al.

[11] Patent Number: 4,640,510

[45] Date of Patent: Feb. 3, 1987

[54] NON-COMPETITIVE GAME FOR TWO OR MORE PLAYERS

[76] Inventors: John C. Braddock; Kathy M. Braddock, both of 1230 Park Ave., New York, N.Y. 10028

[21] Appl. No.: 615,311

[22] Filed: May 30, 1984

[51] Int. Cl.[4] ..... A63F 9/00

[52] U.S. Cl. ..... 273/1 R

[58] Field of Search ..... 273/1 R, 278, 148 R

[56] References Cited

PUBLICATIONS

Sears Christmas Book, 1968, 9-1968, p. 475, "Risk".

*Primary Examiner*—Paul E. Shapiro

*Attorney, Agent, or Firm*—Darby & Darby

[57] ABSTRACT

A game for two or more players is played by assembling a plurality of tokens, assigning a quantitative time value to each of the tokens, and preparing a certificate attesting to ownership of the tokens for purposes of the game. The tokens and certificate are transferred from a first player to a second player, thereby placing the second player in a position to use the tokens to place demands on the time of the first player. At least one token is selectively retransferred back to the first player with a concomitant demand by the second player on the time of the first player, the demand being in accordance with the quantitative time value assigned to the token retransferred. The players then pass an interval of time in accordance with such demand.

17 Claims, 2 Drawing Figures

NON-COMPETITIVE GAME FOR TWO OR MORE PLAYERS

BACKGROUND OF THE INVENTION

This invention relates to games and, more particularly, to a novel game for two or more players which is intended to improve the interpersonal relations between the players.

Many games are known which are intended to be played by two or more persons with the use of tokens and other paraphernalia. Typically, these games are competitive, the object being for one player to defeat the others.

While such games are popular, they do not meet all of the players' recreational needs. In particular, they typically fail to foster a sense of camaraderie and cooperation of the players to the extent that might be wished.

SUMMARY OF THE INVENTION

An object of the invention is to provide a new game that is non-competitive and that fosters a sense of camaraderie and cooperation of the players to a greater extent than games heretofore known.

This object and other objects of the invention are attained in a method of playing a game comprising the steps of assembling a plurality of tokens, assigning a quantitative time value to each of the tokens, and preparing a certificate attesting to ownership of the tokens for purposes of the game.

The tokens and certificate are transferred from a first player to a second player, thereby placing the second player in a position to use the tokens to place demands on the time of the first player.

At least one of the tokens is selectively retransferred back to the first player with a concomitant demand by the second player on the time of the first player. The demand is in accordance with the quantitative time value assigned to the retransferred token.

An interval of time is then passed by the players in accordance with such demand.

Preferably, though not necessarily, a qualitative value is also assigned to each of the tokens, whereby an activity to be performed during such interval of time is determined by the retransferred token.

The quantitative and qualitative values of the tokens may be determined by the first player or by the second player. Alternatively, these values may be predetermined and indicated in some manner on the certificate or on each token.

Preferably, an inner box is provided for accommodating the tokens, and an outer box is provided for accommodating the inner box and the certificate.

BRIEF DESCRIPTION OF THE DRAWING

A better understanding of the invention can be gained from a consideration of the following detailed description of the preferred embodiments thereof, in conjunction with the appended figures of the drawings, wherein.

DESCRIPTION OF THE PREFERRED EMBODIMENTS

Figure 1:
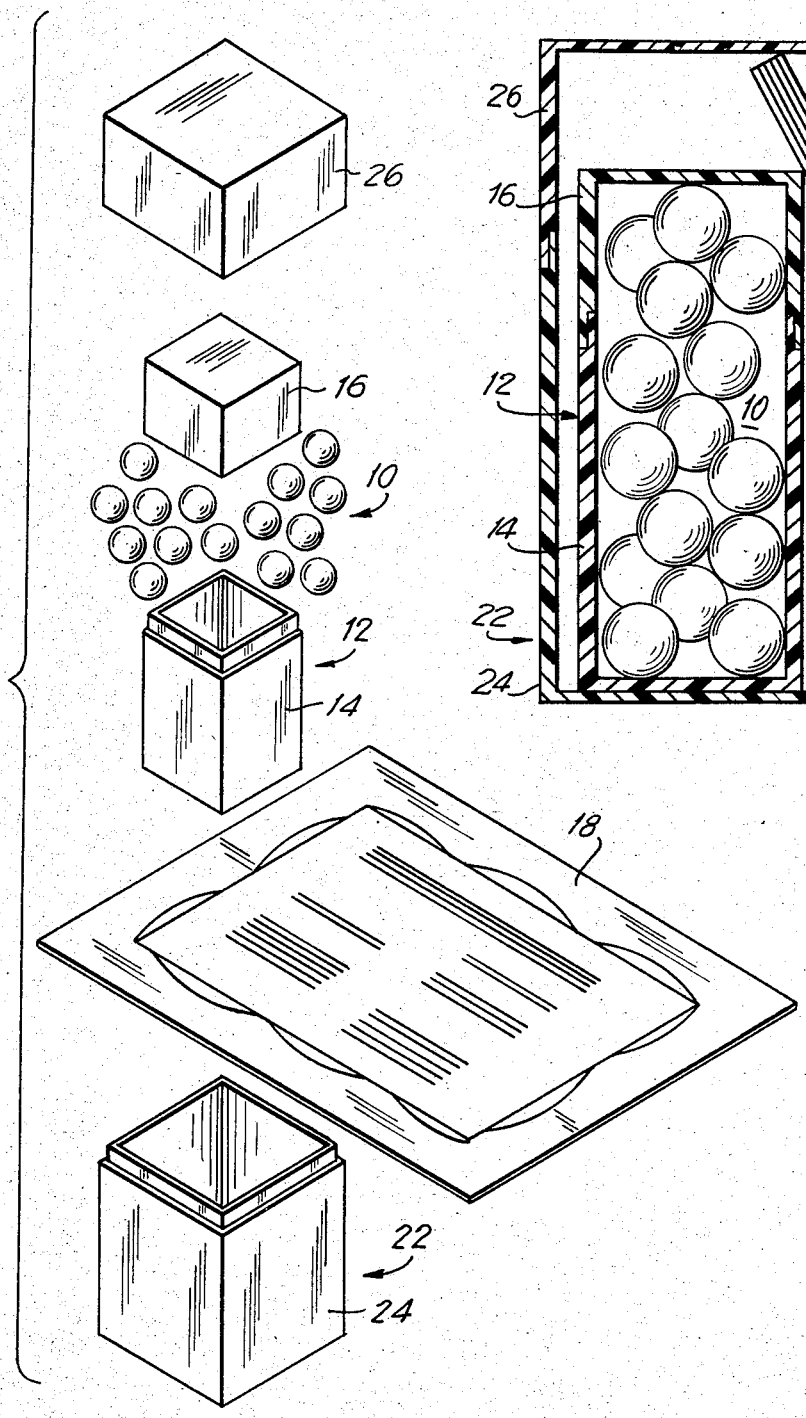
FIG. 1 is an exploded, diagrammatic perspective view of a preferred embodiment of a game set in accordance with the invention.

The figures show a plurality of tokens 10 for use in accordance with the invention. The tokens 10 are preferably colored spheres, and 15 of them can conveniently be provided as part of a game set. The spheres can be of different colors and transparent.

A box 12 is provided for accommodating the spheres. The box 12 is preferably of transparent colored plastic and includes a lower portion 14 and a removable lid 16. In this way, the tokens 10 can be stored in the box 12 or removed therefrom for individual use.

A certificate 18 is employed in accordance with the invention. The certificate 18 preferably resembles a stock certificate and attests to ownership of the tokens 10 for purposes of the game. It designates the name of the "issuer" of the certificate (i.e., the "first player" designated hereinafter, who is normally the purchaser of the game set) and the name of the "owner" of the tokens 10. The "owner" of the tokens 10 is the "second player" referred to hereinafter and is normally a person to whom the game set is transferred.

The certificate 18 can be inscribed with a sentimental verse and the rules of the game.

Figure 2:
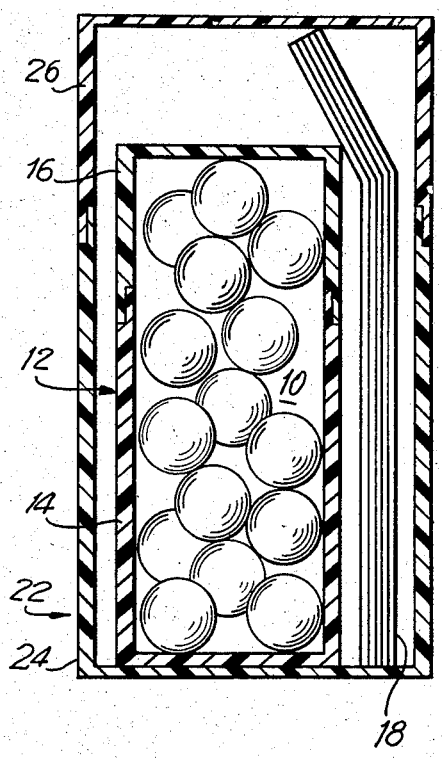
FIG. 2 is an assembled view in vertical section of the game set of FIG. 1.

An outer box 22, preferably of dark opaque plastic, includes a lower portion 24 and a removable upper portion 26. The box 22 accommodates the box 12 (with or without the tokens 10) and the certificate 18 (shown folded in FIG. 2) and constitutes a neat packaging for the game set. The rules of the game and/or a sentimental verse can be inscribed on the outer box 22.

To play the game, the first player transfers the tokens and certificate (for convenience accommodated in the boxes 12 and 22, respectively) to the second player, thereby placing the second player in a position to use the tokens 10 individually to place demands on the time of the first player.

The second player selectively retransfers at least one of the tokens 10 back to the first player with a concomitant demand on the time of the first player. The demand is in accordance with the quantitative time value and, if applicable, the qualitative value, assigned to the token retransferred.

The players then pass an interval of time in accordance with the demand thus made.

The following are examples of the ways in which the players may pass an interval of time in accordance with the invention: a midnight stroll on the beach; a horseback ride in the country; a break from the daily routine; a candlelit meal; an out-of-town trip.

Thus there is provided in accordance with the invention a novel game which fosters a sense of camaraderie and cooperation between the players to a greater extent than conventional games. Many modifications of the preferred embodiment of the game disclosed herein will readily occur to those skilled in the art. For example, while the invention is particularly adapted to be played by two players (such as a husband and wife), it can also be played by three or more players (such as a parent and several children). A parent may, for example, transfer a plurality of tokens, together with a certificate, to each of several children. Accordingly, the invention includes all games and methods of play which are within the scope of the appended claims.

What is claimed is:

1. A method of playing a game comprising the steps of:

assembling a plurality of tokens, assigning a quantitative time value to each of said tokens, preparing a certificate attesting to ownership of said tokens for purposes of the game, transferring said tokens and certificate from a first player to a second player, thereby placing said second player in a position to use said tokens to place demands on the time of said first player, selectively retransferring at least one of said tokens back to said first player with a concomitant demand by said second player on the time of said first player, said demand being in accordance with the quantitative time value assigned to said one token, and passing an interval of time in accordance with said demand.

2. A method as in claim 1 comprising the further step of assigning a qualitative value to each of said tokens, whereby an activity to be performed during said interval is determined by said retransferred token.

3. A method as in claim 2 wherein said first player assigns said qualitative value.

4. A method as in claim 2 wherein said second player assigns said qualitative value.

5. A method as in claim 2 comprising the step of specifying said qualitative value on said certificate.

6. A method as in claim 2 comprising the step of specifying said qualitative value on each of said tokens.

7. A method as in claim 1 wherein said first player assigns said quantitative value.

8. A method as in claim 1 wherein said second player assigns said quantitative value.

9. A method as in claim 1 comprising the step of specifying said quantitative value on said certificate.

10. A method as in claim 1 comprising the step of specifying said quantitative value on each of said tokens.

11. A method as in claim 1 comprising the step of providing an inner box for said tokens and an outer box for said certificate and inner box.

12. A method as in claim 11 comprising the step of inscribing the rules of the game on said outer box.

13. A method as in claim 11 comprising the step of inscribing a sentimental verse on said outer box.

14. A method as in claim 1 comprising the step of inscribing the rules of the game on said certificate.

15. A method as in claim 1 comprising the step of inscribing a sentimental verse on said certificate.

16. A method as in claim 1 comprising the step of designing said certificate to simulate a stock certificate.

17. A method as in claim 1 comprising the step of forming said tokens as colored spheres.

* * * * *